US009108441B2

(12) United States Patent
Yamanobe

(10) Patent No.: US 9,108,441 B2
(45) Date of Patent: Aug. 18, 2015

(54) IMAGE FORMING APPARATUS

(71) Applicant: FUJIFILM Corporation, Tokyo (JP)

(72) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/951,309

(22) Filed: Jul. 25, 2013

(65) Prior Publication Data

US 2014/0049578 A1 Feb. 20, 2014

(30) Foreign Application Priority Data

Aug. 20, 2012 (JP) ..... 2012-181774

(51) Int. Cl.

| | |
|---|---|
| ***B41J 29/38*** | (2006.01) |
| ***B41J 2/01*** | (2006.01) |
| ***B41J 13/00*** | (2006.01) |
| ***B41J 3/60*** | (2006.01) |
| ***B41J 11/00*** | (2006.01) |

(52) U.S. Cl.

CPC ..... *B41J 13/0036* (2013.01); *B41J 3/60* (2013.01); *B41J 11/002* (2013.01); *B41J 13/009* (2013.01)

(58) Field of Classification Search

USPC ..... 347/16, 23, 19, 26, 101–102

See application file for complete search history.

(56) References Cited

U.S. PATENT DOCUMENTS

| | | | | |
|---|---|---|---|---|
| 8,434,849 | B2 | 5/2013 | Kurasawa et al. | |
| 8,644,717 | B2 * | 2/2014 | Mori | 399/21 |
| 2009/0041485 | A1 | 2/2009 | Shoji et al. | |
| 2011/0128319 | A1 * | 6/2011 | Mitsuzawa | 347/16 |
| 2012/0139993 | A1 | 6/2012 | Yamada et al. | |

FOREIGN PATENT DOCUMENTS

| | | | |
|---|---|---|---|
| JP | S60-132863 | A | 7/1985 |
| JP | 2009-040606 | A | 2/2009 |

(Continued)

OTHER PUBLICATIONS

An Office Action; "Notice of Reasons for Rejection," issued by the Japanese Patent Office on Aug. 5, 2014, which corresponds to Japanese Patent Application No. 2012-181774 and is related to U.S. Appl. No. 13/951,309; with English language translation of relevant portions.

(Continued)

*Primary Examiner* — Jason Uhlenhake

(74) *Attorney, Agent, or Firm* — Studebaker & Brackett PC

(57) ABSTRACT

An image forming apparatus includes: a recording material applying member configured to apply a recording material to a recording medium; a fixing member configured to fix a recording material to the medium; a first transportation unit configured to transport the medium to the recording material applying member and the fixing member; a discharge unit configured to discharge the medium; a second transportation unit configured to return the medium to the recording material applying unit; a reverse unit configured to reverse front and back surfaces of the recording medium provided in the second transportation unit; a transportation path switching unit configured to transport the medium to the discharge unit or the second transportation unit; and a control device configured to control the transportation path switching unit so as to transport the medium to the discharge unit when a fixing ability of the fixing member is decreased.

14 Claims, 12 Drawing Sheets

(56) References Cited

FOREIGN PATENT DOCUMENTS

| | | | | |
|---|---|---|---|---|
| JP | 2011-224932 | A | | 11/2011 |
| JP | 2012-093648 | A | | 5/2012 |
| JP | 2012093648 | A | * | 5/2012 |
| JP | 2012-116141 | A | | 6/2012 |

OTHER PUBLICATIONS

An Office Action; "Notice of Reasons for Rejection," issued by the Japanese Patent Office on May 27, 2014, which corresponds to Japanese Patent Application No. 2012-181774 and is related to U.S. Appl. No. 13/951,309; with English language translation.

* cited by examiner

IMAGE FORMING APPARATUS

BACKGROUND OF THE INVENTION

1. Field of the Invention

The present invention relates to an image forming apparatus.

2. Description of the Related Art

An image forming apparatus has been known, which performs image formation by ejecting a liquid droplet from a liquid ejecting head and the like to one surface of a recording medium, and also performs image formation on the other surface by reversing the recording medium. In such an image forming apparatus which is capable of performing the image formation on both surfaces, a liquid droplet is fixed on one surface of the recording medium, and then the image formation is performed on the other surface. Accordingly, an unfixed liquid droplet is inhibited from being attached into the apparatus.

JP2011-224932A discloses a printer which is controlled so as to decrease an output of a heater if transportation of a sheet is stopped in a dryer due to occurrence of a jam and the like.

SUMMARY OF THE INVENTION

In the meantime, if a recording material (liquid droplet) is not fixed to the recording medium due to a decreased fixing ability of a fixing member, when the recording medium passes through a transportation path, the recording material may be attached to transportation means and the like which configure the transportation path, thereby contaminating the transportation path.

The present invention has been made in view of such circumstances and provides an image forming apparatus which is capable of forming an image on both surfaces of a recording medium, and is capable of inhibiting a transportation path from being contaminated by a recording material when the fixing ability of a fixing member is decreased.

According to a first aspect of the present invention, there is provided an image forming apparatus including a recording material applying member configured to apply a recording material to a recording medium, a fixing member configured to fix the recording material to the recording medium, a first transportation unit configured to transport the recording medium to the recording material applying member and the fixing member, a discharge unit configured to discharge the recording medium received from the first transportation unit, a second transportation unit configured to return the recording medium received from the first transportation unit to the recording material applying member, a reverse unit configured to reverse front and back surfaces of the recording medium, the reverse unit being provided in the second transportation unit, a transportation path switching unit configured to transport the recording medium transported by the first transportation unit to the discharge unit or the second transportation unit, and a control device configured to control the transportation path switching unit so as to transport the recording medium to the discharge unit when a fixing ability of the fixing member is decreased.

In the image forming apparatus according to the first aspect, the first transportation unit transports the recording medium to the recording material applying member to apply the recording material to the recording medium, and further transports the recording medium to the fixing member to fix the recording material to the recording medium.

The transportation path of the recording medium transported by the first transportation unit is switched to any one of the discharge unit and the second transportation unit by the transportation path switching unit. The discharge unit can discharge the recording medium received from the first transportation unit. The second transportation unit can return the recording medium received from the first transportation unit to the recording material applying member. The recording material can be again applied to the recording medium returned to the recording material applying member by the recording material applying member. Moreover, it is also possible to fix the recording material using the fixing member. Since the reverse unit is provided in the second transportation unit, it is possible to return the recording medium to the recording material applying member in a state where the front and the back of the recording medium are reversed.

When the fixing ability of the fixing member is decreased, the control device controls the transportation path switching unit so as to transport the recording medium to the discharge unit. Even if the recording material is not fixed on the recording medium due to a decrease in the fixing ability of the fixing member, the recording medium is discharged to the discharge unit, but is not sent to the second transportation unit. That is, when the fixing ability of the fixing member is decreased, the first transportation unit and the second transportation unit are inhibited from being contaminated by the recording material.

According to a second aspect of the present invention, in the first aspect, the reverse unit may be configured to be switched between a reverse operation reversing the recording medium and a non-reverse operation not reversing the recording medium.

In other words, when the reverse unit performs the non-reverse operation, a recording medium where the recording material is fixed by the fixing member or a recording medium to which the recording material is not applied can be returned to the recording material applying member without being reversed.

According to a third aspect of the present invention, in the second aspect, the image forming apparatus may further include a transportation failure detection unit configured to detect a transportation failure of the recording medium. When the transportation failure is detected by the transportation failure detection unit, the control device may control the transportation path switching unit so as to discharge the recording medium staying at the upstream side of the fixing member to the discharge unit.

In a case of the transportation failure of the recording medium, the control device decreases the fixing ability of the fixing member. Accordingly, it is possible to easily perform an operation of removing the cause of the transportation failure (for example, a jammed recording medium). Then, in a state where the fixing ability of the fixing member is decreased (when the fixing ability is decreased), the control device controls the transportation path switching unit so as to transport the recording medium staying at the upstream side of the fixing member (including an intermediate state of being fixed by the fixing member), that is, the recording medium where an image is not fixed, to the discharge unit. Accordingly, the first transportation unit and the second transportation unit are inhibited from being contaminated.

According to a fourth aspect of the present invention, in the second or the third aspect, the image forming apparatus may further include a fixing ability detection unit configured to detect a fixing ability of the fixing member.

A decrease in the fixing ability of the fixing member can be detected by the fixing ability detection unit. Then, in a state where the fixing ability of the fixing member is decreased (when the fixing ability is decreased), the control device causes the recording medium to be discharged to the discharge unit. Accordingly, the first transportation unit and the second transportation unit are inhibited from being contaminated.

According to a fifth aspect of the present invention, in the third aspect, the control device may stop the first transportation unit and the second transportation unit in a case of the transportation failure.

Stopping the first transportation unit and the second transportation unit when the transportation fails can inhibit the recording medium where the recording material is not fixed from occurring further. In addition, this can facilitate an operation of removing a factor for the transportation failure.

According to a sixth aspect of the present invention, in the fifth aspect, in the case of the transportation failure, the control device may control the transportation path switching unit so as to transport the recording medium, which has one surface where an image is not formed and the other surface where there is no unfixed image, to the second transportation unit.

When the transportation of recording medium is failed, the recording medium, which has one surface where an image is not formed and the other surface where there is no unfixed image, is transported to the second transportation unit. The recording medium is sent to the recording material applying member by the second transportation unit. That is, it is possible to apply the recording material to the recording medium again from the recording material applying member. When the fixing ability of the fixing member is recovered, an image can be recorded to the recording medium by fixing the recording material to the recording medium, thereby inhibiting the waste of the recording medium. The recording medium has one surface where an image is not formed and the other surface where there is no unfixed image (including a case where an image is not recorded and a case where a fixed image is recorded), so that the second transportation unit is unlikely to be contaminated.

According to a seventh aspect of the present invention, in the sixth aspect, the control device may control the reverse unit so as not to reverse the recording medium in the case of the transportation failure.

The recording medium is not reversed when the transportation of recording medium fails. Accordingly, in the case where the recording medium has first and second surfaces which are distinguished from each other, an image to be formed on a first surface can be formed again on the first surface (one surface) where an image is not formed. Thereafter, if necessary, it is possible to form an image to be formed on a second surface again on the second surface (the other surface).

According to an eighth aspect of the present invention, in the fourth aspect, the control device may stop the recording material applying member when the fixing ability is decreased.

Stopping the recording material applying member when the fixing ability is decreased can inhibit the recording medium where the recording material is not fixed from occurring further.

The terms of "when the fixing ability is decreased" herein correspond to a case where the fixing ability of the fixing member is decreased due to some factors, and this is detected by the fixing ability detection unit. However, even in a case where the fixing ability of the fixing member is actively decreased when transportation of the recording medium is failed, this can be detected again using the fixing ability detection unit, therefore such case may also be included in "when the fixing ability is decreased".

According to a ninth aspect of the present invention, in the eighth aspect, when the fixing ability is decreased, the control device may control the transportation path switching unit so as to transport the recording medium, which has one surface where an image is not formed and the other surface where there is no unfixed image, to the second transportation unit.

When the fixing ability is decreased, the recording medium, which has one surface where an image is not formed and the other surface where there is no unfixed image, is transported to the second transportation unit. The recording medium is sent to the recording material applying member by the second transportation unit. That is, it is possible to apply the recording material to the recording medium from the recording material applying member. When the fixing ability of the fixing member recovers, fixing the recording material to the recording medium makes it possible to record an image on the recording medium and to inhibit the recording medium from being wasted. The recording medium has one surface where an image is not formed and the other surface where there is no unfixed image (including a case where an image is not recorded and a case where a fixed image is recorded), and thereby the second transportation unit is unlikely to be contaminated.

According to a tenth aspect of the present invention, in the ninth aspect, the control device may control the reverse unit so as not to reverse the recording medium when the fixing ability is decreased.

The recording medium is not reversed when the fixing ability is decreased. Accordingly, in the case where the recording medium has first and second surfaces which are distinguished from each other, an image to be formed on a first surface can be formed again on the first surface (one surface) where an image is not formed. Thereafter, if necessary, an image to be formed on a second surface can be formed again on the second surface (the other surface).

With the configuration as described above, according to the aspects of the present invention, it is possible to form an image on both surfaces of the recording medium, and to inhibit the transportation path from being contaminated when the fixing ability of the fixing member is decreased.

DESCRIPTION OF THE PREFERRED EMBODIMENTS

Whole Configuration of Ink Jet Recording Apparatus

Figure 1:
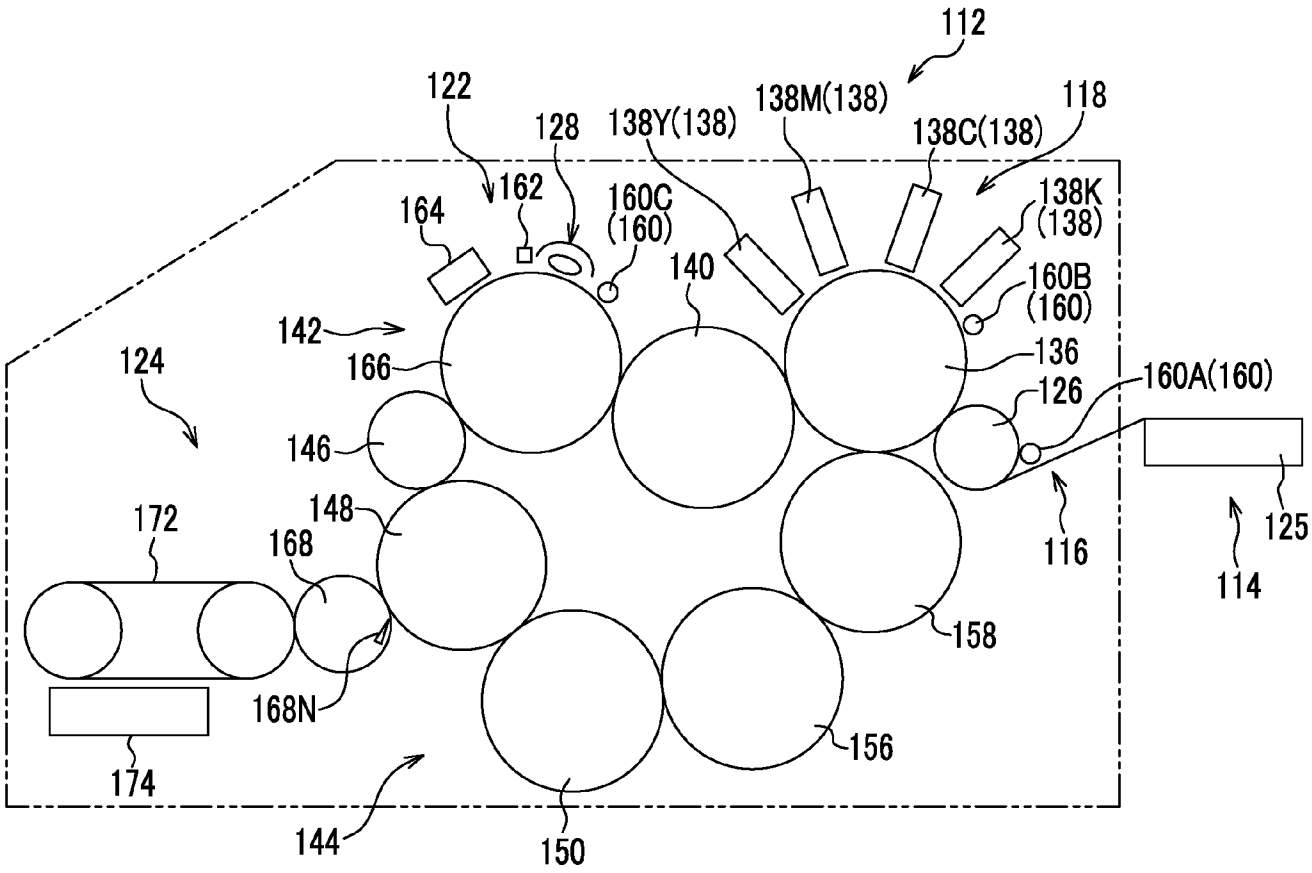
FIG. 1 is a front view illustrating an ink jet recording apparatus according to a first embodiment of the present invention.

FIG. 1 illustrates an ink jet recording apparatus 112 according to a first embodiment of the present invention. The ink jet recording apparatus 112 includes a sheet feed unit 114, an image recording unit 118, and a fixing unit 122. Moreover, the ink jet recording apparatus 112 includes a first transportation unit 142 transporting a sheet 154 (refer to FIG. 2) which is an example of a recording medium. While sequentially transporting the sheet 154 by the first transportation unit 142, the ink jet recording apparatus 112 records an image on the sheet 154. In addition, as described below, a discharge unit 124 and a second transportation unit 144 are provided on the downstream side of the first transportation unit 142.

A plurality of sheets 154 different in a paper type or a size (size of the medium) can be used as the sheet 154. The following describes an example of a case where a sheet of paper (cut sheet) is used as the sheet 154. In addition, in the present embodiment, it is assumed that a sheet having the 'front' surface and the 'back' surface, which are distinguished from each other, is used as the sheet 154. In the followings, the front surface is appropriately referred to as a first surface and the back surface is appropriately referred to as a second surface.

In the sheet feed unit 114, the sheet 154 is stacked on a sheet feed tray 125. The sheet 154 is sent out one by one in the sheet feed unit 114. The sheet 154 which is sent out is sent to the image recording unit 118 through a sheet feed drum 126 of a feed unit 116.

In the image recording unit 118, while the sheet 154 is held at an image recording drum 136 and transported, ink droplets ejected from the ink jet recording head 138 disposed above the image recording drum 136 are attached to the sheet 154. Accordingly, an image is recorded on a surface of the sheet 154. The ink jet recording head 138 is an example of the recording material applying member.

In the present embodiment, an ink is used, which is cured when ultraviolet rays are emitted, and is possibly fixed to the sheet 154. In addition, in the present embodiment, ink jet recording heads 138K, 138C, 138M, and 138Y of four basic colors black (K), Cyan (C), Magenta (M), and Yellow (Y) are disposed along a peripheral direction of the image recording drum 136. Each ink jet recording head 138 is a so-called full-line head having an ink ejection range corresponding to the maximum width of the sheet 154.

A processing liquid application unit may be provided which applies a predetermined processing liquid on the sheet 154 for the purpose of inhibiting an ink from unintentionally spreading on one surface or both surfaces of the front and the back of the image recording unit 118. An example of the processing liquid may include a liquid containing a component to condense or thicken a color material (pigment or dye) in an ink provided for the sheet 154 in the image recording unit 118. The processing liquid and the ink come in a contact with each other, and thereby separation between the color material and a solvent is facilitated in the ink. In addition, as a providing method for providing the processing liquid for the sheet 154, there are droplet ejection by ejecting the processing liquid from the ink jet head, application using a roller, uniform provision using a spray, and the like.

The sheet 154 on which an image is recorded by the image recording unit 118 is sent to the fixing unit 122 through a transportation drum 140. In the present embodiment, the fixing unit 122 includes an ultraviolet emitter 128 disposed with a predetermined space from an outer periphery of a fixing roller 166. Emitting ultraviolet rays to an image which has not been fixed yet on the sheet 154 performs fixation of an image and obtains a fixed image FI. The ultraviolet emitter 128 is an example of the fixing member.

Between the image recording unit 118 and the fixing unit 122, a drying unit drying a solvent (water) in the ink may be provided.

On the downstream side of the fixing unit 122, a transportation roller 146 configuring the first transportation unit 142, and a branch section roller 148 where the sheet 154 is transported through the transportation roller 146 are provided. On the downstream side of the branch section roller 148, a discharge roller 168 (the discharge unit 124) and a reverse roller 150 (the second transportation unit 144) are provided. The reverse roller 150 is an example of the reverse unit.

In the branch section roller 148, a transportation path of the sheet 154 is branched into a path reaching the discharge unit 124 and a path reaching the second transportation unit 144. Between the reverse roller 150 and the image recording drum 136, transportation rollers 156 and 158 are provided. In the present embodiment, the second transportation unit 144 includes the reverse roller 150 and the transportation rollers 156 and 158.

As described below, when an unfixed image UI (an image to be fixed but is not yet fixed, refer to FIGS. 6A to 6E) occurs on the sheet 154, the unfixed image UI faces the transportation roller 146 and the discharge roller 168. Accordingly, on the outer peripheral surface of the transportation roller 146 and the discharge roller 168, a recess portion is formed so that a portion on the sheet 154 where an image is recorded may not be in contact therewith. Accordingly, an ink of the unfixed image UI is not unintentionally attached.

On the periphery of the discharge roller 168, a pinching claw 168N is provided. The pinching claw 168N can pinch the leading edge portion of the sheet 154 which is being transported by the branch section roller 148. When pinched at the pinching claw 168N, the sheet 154 is sent to the discharge unit 124. Then, a plurality of sheets 154 are transported from the discharge roller 168 by a discharge belt 172 and stacked at a sheet discharge tray 174.

In contrast, when the pinching claw 168N does not pinch the leading edge portion of the sheet 154, the sheet 154 is further transported on the branch section roller 148, and sent to the second transportation unit 144. As known from this, the discharge roller 168 (the pinching claw 168N) is an example of the transportation path switching unit.

Figure 2A:
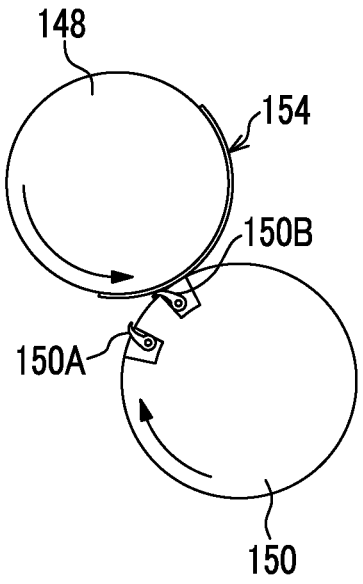
FIG. 2A is a schematic front view illustrating a reverse operation by a reverse roller in the ink jet recording apparatus according to the first embodiment of the present invention.
Figure 2B:
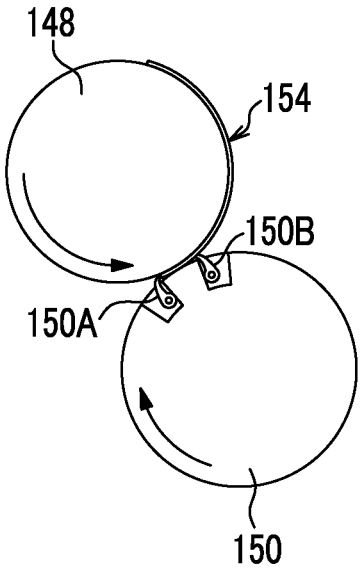
FIG. 2B is a schematic front view illustrating the reverse operation by the reverse roller in the ink jet recording apparatus according to the first embodiment of the present invention.
Figure 2C:
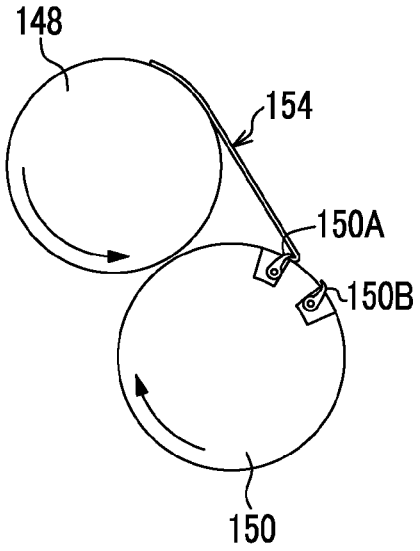
FIG. 2C is a schematic front view illustrating the reverse operation by the reverse roller in the ink jet recording apparatus according to the first embodiment of the present invention.
Figure 2D:
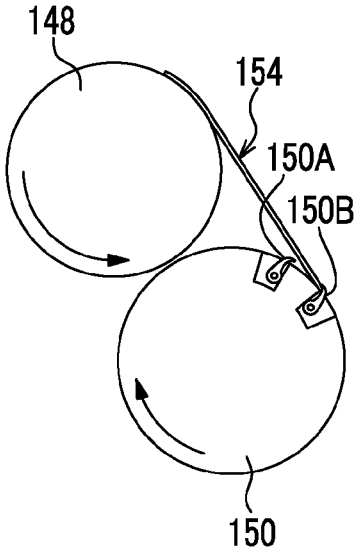
FIG. 2D is a schematic front view illustrating the reverse operation by the reverse roller in the ink jet recording apparatus according to the first embodiment of the present invention.
Figure 3A:
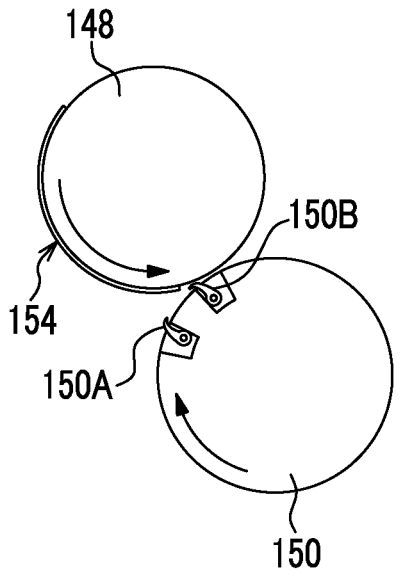
FIG. 3A is a schematic front view illustrating a non-reverse operation by the reverse roller in the ink jet recording apparatus according to the first embodiment of the present invention.
Figure 3B:
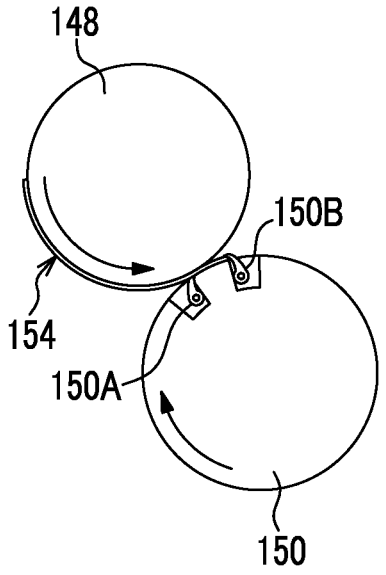
FIG. 3B is a schematic front view illustrating the non-reverse operation by the reverse roller in the ink jet recording apparatus according to the first embodiment of the present invention.
Figure 3C:
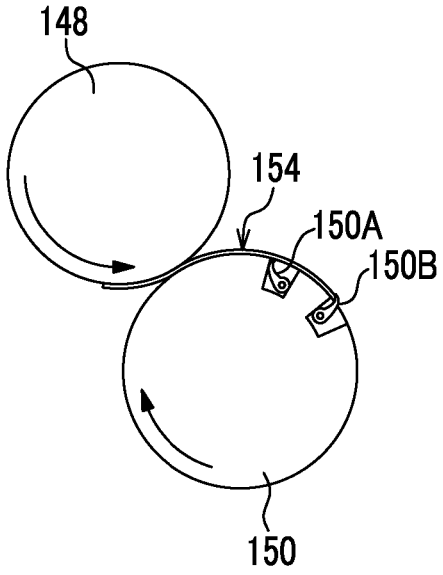
FIG. 3C is a schematic front view illustrating the non-reverse operation by the reverse roller in the ink jet recording apparatus according to the first embodiment of the present invention.

As shown in detail in FIGS. 2 and 3, on the periphery of the reverse roller 150, a reverse claw 150A and a transportation claw 150B are provided. Both the reverse claw 150A and the transportation claw 150B can partially pinch the sheet 154. However, the reverse claw 150A and the transportation claw 150B are provided at positions deviated from each other in the peripheral direction and the axial direction of the reverse roller 150 so as not to unintentionally interfere with each other.

When reversing the sheet 154 (reverse operation), as shown in FIG. 2A, the sheet 154 is first transported on the branch section roller 148. Then, as shown in FIG. 2B, the reverse claw 150A pinches the trailing edge portion of the sheet 154 held at the branch section roller 148. When the reverse roller 150 rotates in the state, the trailing edge portion of the sheet 154 (a portion pinched at the reverse claw 150A) is a leading edge portion on the reverse roller 150. Then, as shown in FIG. 2C, a portion of the sheet 154 pinched at the reverse claw 150A is pinched again by the transportation claw 150B, and at the same time the pinching by the reverse claw 150A is released.

Thereafter, when the reverse roller 150 further rotates as shown in FIG. 2D, the sheet 154 is reversed. Then, by the transportation roller 156 and 158, the sheet 154 is returned to the image recording drum 136 (an upstream side of the first transportation unit 142).

When the sheet 154 is not reversed (a non-reverse operation), as shown in FIG. 3A, the sheet 154 is first transported on the branch section roller 148 just like the reverse operation. Then, as shown in FIG. 3B, the transportation claw 150B pinches the leading edge portion of the sheet 154 held at the branch section roller 148. When the reverse roller 150 rotates in the state, the sheet 154 is returned to the image recording drum 136 (an upstream side of the first transportation unit 142) by the transportation roller 156 and 158 without being reversed.

Accordingly, the reverse roller 150 can switch between an operation of reversing the front and the back of the sheet 154 and an operation of not reversing the front and the back of the sheet 154.

As shown in FIG. 1, the ink jet recording apparatus 112 has a sheet jam sensor 160 provided at a predetermined position of the first transportation unit 142. The sheet jam sensor 160 is an example of the transportation failure detection unit.

As an example in the present embodiment, three sheet jam sensors 160 are disposed such as a sheet jam sensor 160A at the upstream side of the sheet feed drum 126 of a feed unit 116, a sheet jam sensor 160B at the upstream side of the ink jet recording head 138 in the image recording unit 118, and a sheet jam sensor 160C at the upstream side of the ultraviolet emitter 128 in the fixing unit 122.

The sheet jam sensor 160A detects whether or not the sheet 154 is successfully delivered to the sheet feed drum 126. The sheet jam sensor 160B detects whether the sheet 154 floats so as to collide with the ink jet recording head 138. The sheet jam sensor 160C detects whether the sheet 154 floats so as to collide with the ultraviolet emitter 128. There is no limit to a position of the sheet jam sensor 160, and the sheet jam sensor 160 may be provided at a position except for these positions.

Moreover, in the ultraviolet emitter 128 of the fixing unit 122, a fixing unit operation sensor 162 is provided which detects a decrease in the fixing ability based on an operation state of the fixing unit 122. The fixing unit operation sensor 162 is an example of the fixing ability detection unit.

As the fixing unit operation sensor 162, in the present embodiment, a light amount sensor is used which detects a light amount of ultraviolet rays from the ultraviolet emitter 128. However, instead of or in combination with this, a sensor may be used which detects a flowing current or an applied voltage to the ultraviolet emitter 128. In short, as the fixing unit operation sensor 162, it is possible to apply various optimum sensors according to a type (fixing method) of the fixing unit 122.

On the downstream side of the ultraviolet emitter 128 in the fixing unit 122, an image reading sensor 164 reading an image fixed on the sheet 154 is provided.

Figure 4:
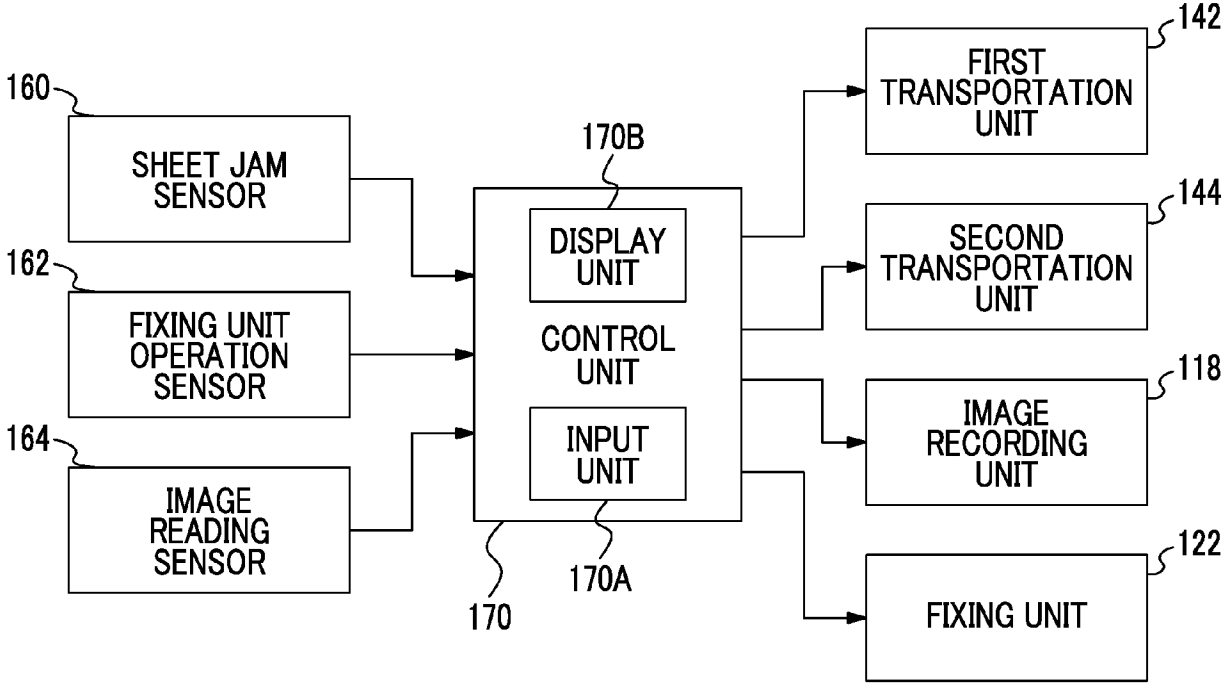
FIG. 4 is a block diagram of the ink jet recording apparatus according to the first embodiment of the present invention.

As shown in FIG. 4, detection information in the sheet jam sensor 160, the fixing unit operation sensor 162, and the image reading sensor 164 is sent to the control unit 170 (a control device). The control unit 170, based on information input from an user or detection information from these sensors, controls an operation of the first transportation unit 142, the second transportation unit 144, the image recording unit 118 (the ink jet recording head 138), and the fixing unit 122. The control unit 170 includes an input unit 170A to which a user inputs a predetermined manipulation, and a display unit 170B displaying various kinds of states of the ink jet recording apparatus 112. However, the input unit 170A and the display unit 170B may be configured as a separate member from the control unit 170. In addition, like a so-called touch screen, the input unit 170A and the display unit 170B may be integrated.

Operation in Recording Image

Next, an operation in recording an image on the sheet 154 in the ink jet recording apparatus 112 of the present embodiment and an operation of the ink jet recording apparatus 112 will be described. In FIGS. 5A to 5F, and FIGS. 6A to 6E, a first surface 154A and a second surface 154B of the sheet 154 are distinguished from each other. In addition, as to be described below, an image (a fixed image FI) fixed to the sheet 154 is shown in a solid line, and an image not fully fixed (an unfixed image UI) is shown in a dotted line. Moreover, in FIGS. 5A to 5F, and FIGS. 6A to 6E, some members in the ink jet recording apparatus 112 are not illustrated.

First, a normal image recording operation is described. In the normal image recording operation, a jam of the sheet 154 does not occur, and the sheet jam sensor 160 does not detect the jam of the sheet. In addition, since the fixing unit 122 normally operates, the fixing unit operation sensor 162 does not detect a decrease in the fixing ability.

The sheet 154 transported from the sheet feed tray 125 is transported by the first transportation unit 142 through the sheet feed drum 126 of the feed unit 116. Then, the sheet 154 is first delivered to the image recording drum 136, and sent to the image recording unit 118. In the image recording unit 118, the first surface 154A faces the ink jet recording head 138, and an ink droplet ejected from the ink jet recording head 138 is attached onto the first surface 154A of the sheet 154.

The sheet 154 is delivered from the transportation drum 140 to the fixing roller 166. In the fixing unit 122, emitting ultraviolet rays to the ink droplet attached to the first surface 154A of the sheet 154 fixes the ink droplet.

Thereafter, the sheet 154 reaches the branch section roller 148 through the transportation roller 146. Here, when image recording is performed only on the first surface 154A of the sheet 154, the pinching claw 168N of the discharge roller 168 pinches the leading edge portion of the sheet 154. Accordingly, the sheet 154 is sent to the discharge unit 124. Then, the sheet 154 is further transported by the discharge belt 172 from the discharge roller 168, and discharged to the sheet discharge tray 174.

Figure 5A:
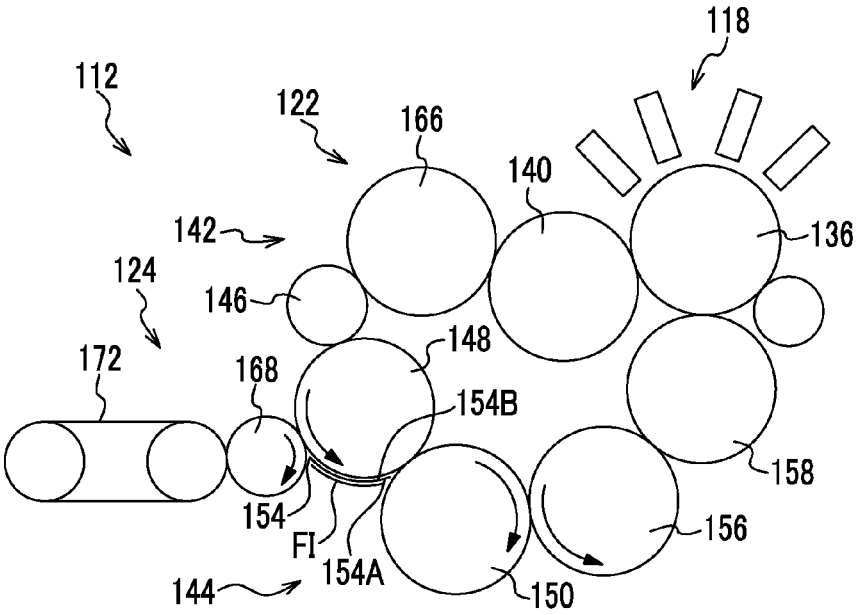
FIG. 5A is a schematic front view illustrating a normal operation performing image recording in the ink jet recording apparatus according to the first embodiment of the present invention.

When image recording is also performed on the second surface 154B of the sheet 154, the pinching claw 168N of the discharge roller 168 does not pinch the sheet 154. Accordingly, the sheet 154 is further transported on the branch section roller 148, and, as shown in FIG. 5A, the leading edge portion of the sheet 154 reaches the reverse roller 150.

Then, as also shown in FIG. 2B, the trailing edge portion of the sheet 154 is pinched at the reverse claw 150A. If the reverse roller 150 rotates in the state, a portion of the sheet 154 pinched at the reverse claw 150A is a leading edge portion on the reverse roller 150, and the sheet 154 is transported by the reverse roller 150. Then, the transportation claw 150B newly pinches the leading edge portion of the sheet 154, and at the same time the reverse claw 150A releases the pinched sheet 154.

Figure 5B:
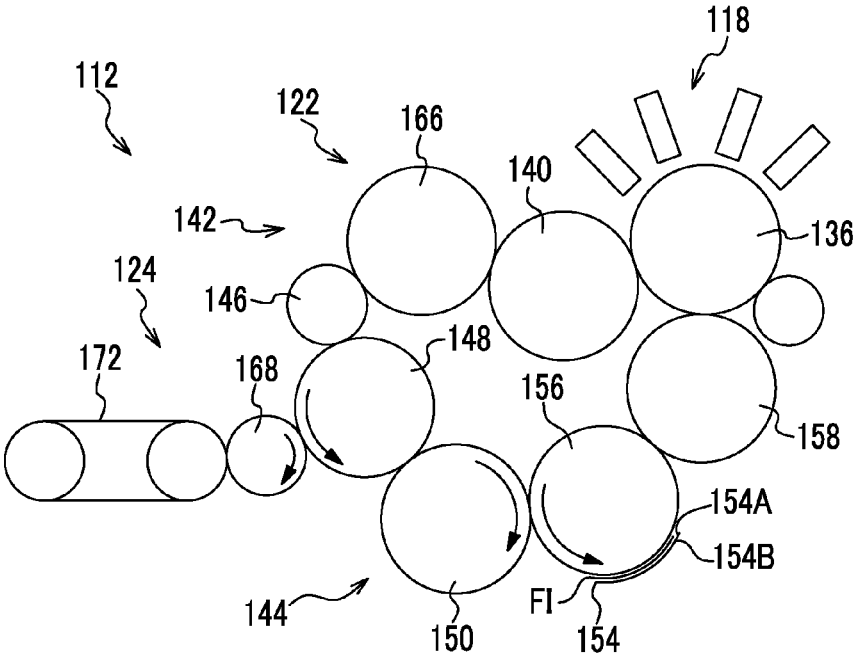
FIG. 5B is a schematic front view illustrating a normal operation performing image recording in the ink jet recording apparatus according to the first embodiment of the present invention.
Figure 5C:
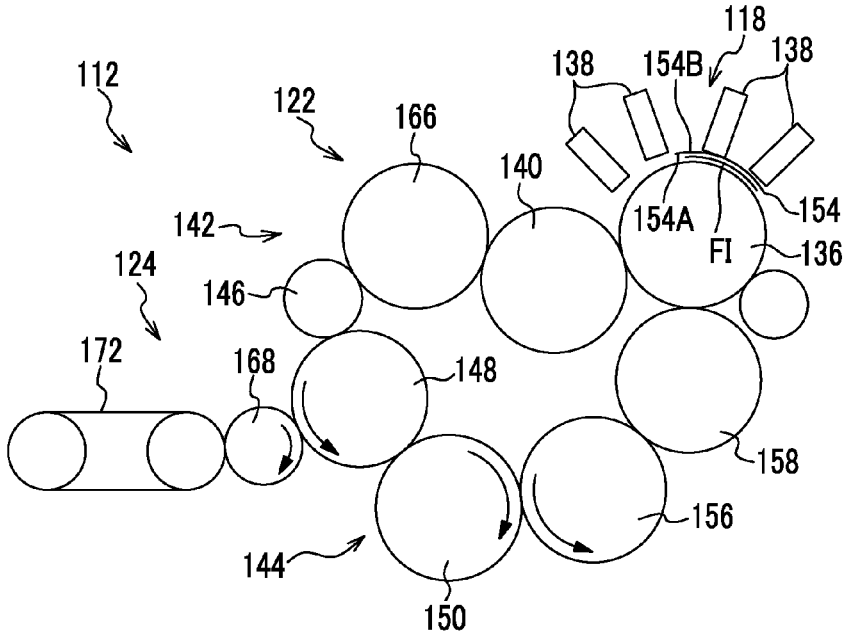
FIG. 5C is a schematic front view illustrating a normal operation performing image recording in the ink jet recording apparatus according to the first embodiment of the present invention.
Figure 5D:
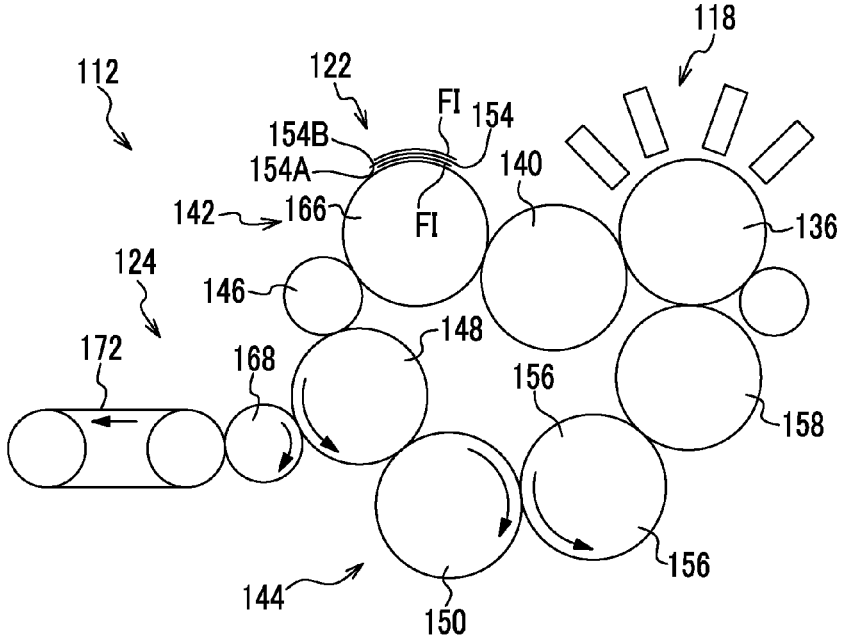
FIG. 5D is a schematic front view illustrating a normal operation performing image recording in the ink jet recording apparatus according to the first embodiment of the present invention.

Thereafter, as shown in FIG. 5B, the sheet 154 is transported by the transportation roller 156 and 158, and returned to the image recording unit 118(ink jet recording head 138) from the image recording drum 136 (the upstream side in the first transportation unit 142). At this time, as shown in FIG. 5C, since the second surface 154B of the sheet 154 faces the ink jet recording head 138, it is possible to record an image by ejecting an ink droplet from the ink jet recording head 138 on the second surface 154B. Furthermore, as shown in FIG. 5D, the fixing unit 122 fixes an ink droplet on the second surface 154B.

Figure 5E:
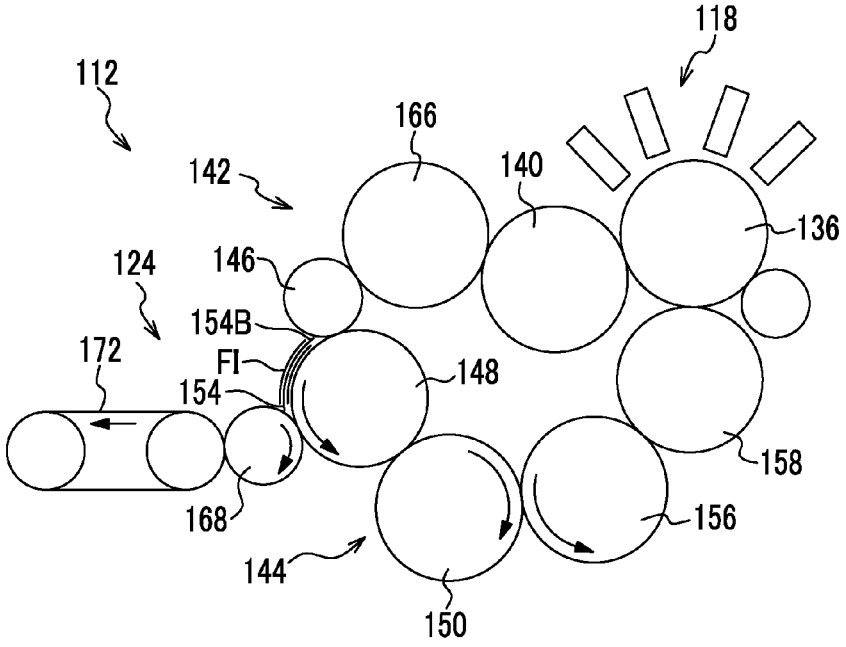
FIG. 5E is a schematic front view illustrating a normal operation performing image recording in the ink jet recording apparatus according to the first embodiment of the present invention.
Figure 5F:
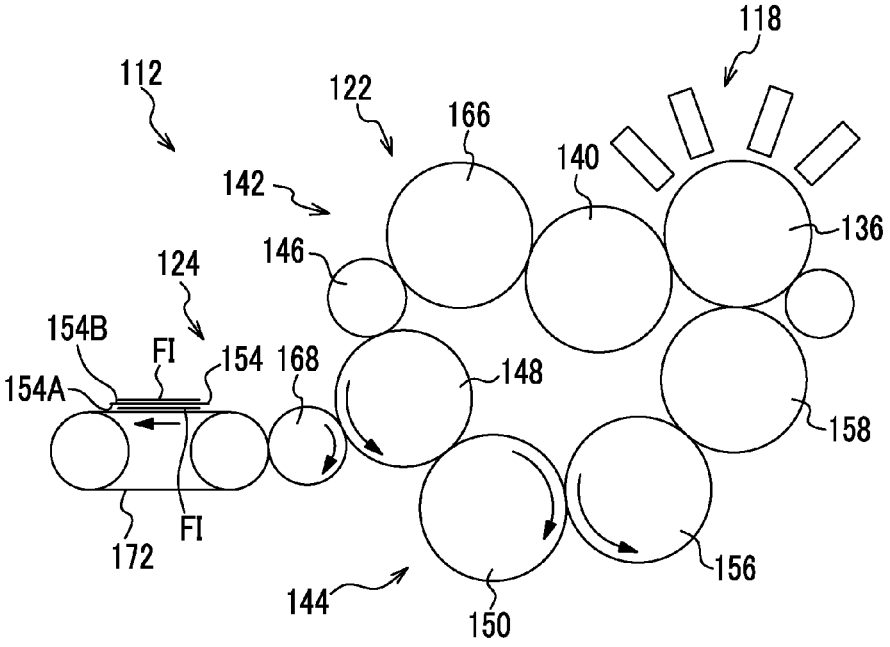
FIG. 5F is a schematic front view illustrating a normal operation performing image recording in the ink jet recording apparatus according to the first embodiment of the present invention.

Then, the sheet 154 on which an image is formed on both surfaces thereof is transported by the branch section roller 148. As shown in FIG. 5E, when the leading edge portion of the sheet 154 reaches the discharge roller 168, the leading edge portion is pinched by the pinching claw 168N of the discharge roller 168, and transported to the discharge roller 168. Accordingly, as shown in FIG. 5F, the sheet 154 is further transported and discharged from the discharge roller 168 by the discharge belt 172.

Next, an operation will be described in a case where the sheet jam sensor 160 detects a jam of the sheet. In this case, the control unit 170 stops transportation of the sheet 154 by the first transportation unit 142. Accordingly, the jam of the sheet 154 is inhibited from occurring further.

Furthermore, the control unit 170 decreases the fixing ability of the fixing unit 122 (the ultraviolet emitter 128) (when the fixing ability is decreased). Accordingly, workability in a removal operation of the jammed sheet 154 increases.

When the fixing ability of the fixing unit 122 is decreased, in the ink jet recording apparatus 112, the sheet 154 on which an image is being recorded (an image is not yet fixed) may be present. This sheet 154 on which an image is being recorded (an image is not yet fixed) may include, for example, the sheet 154 on which an image is being recorded by the ink jet recording head 138 when the jam of the sheet occurs, the sheet 154 which does not reach the fixing unit 122 even if the image recording is finished, and the sheet 154 which is being fixed by the fixing unit 122.

Figure 6A:
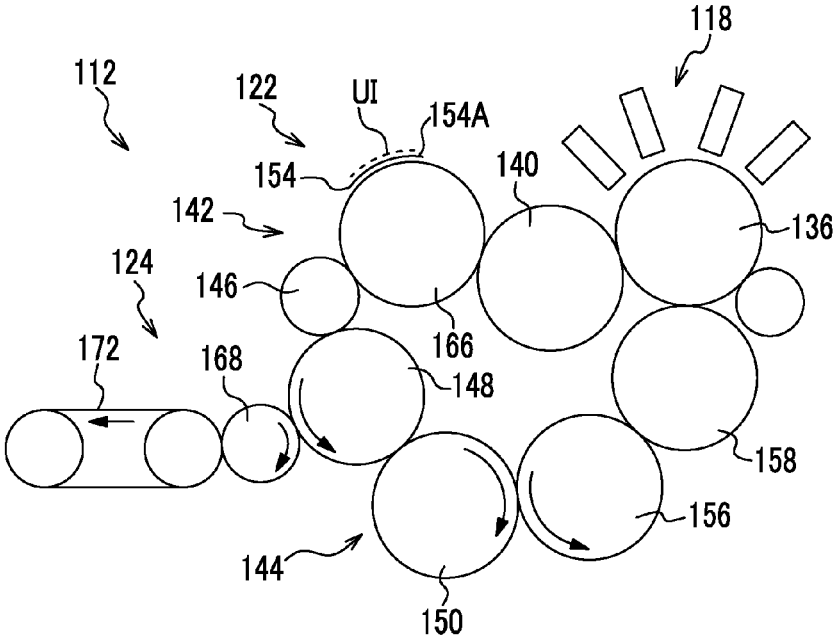
FIG. 6A is a schematic front view illustrating an operation in an occurrence of a sheet having an unfixed image in the ink jet recording apparatus according to the first embodiment of the present invention.

The control unit 170, as shown in FIG. 6A, discharges the sheet 154 on which an image of the first surface 154A is not yet fixed from the ink jet recording apparatus 112. This sheet 154 is a sheet to be normally reversed by the second transportation unit 144 and to be sent to the image recording unit 118 if an image were fixed thereon.

Figure 6B:
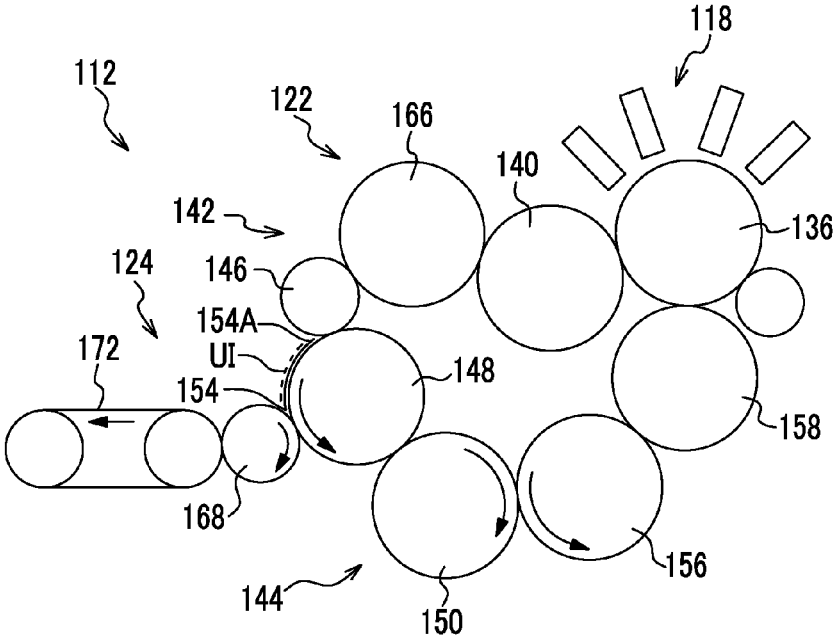
FIG. 6B is a schematic front view illustrating an operation in an occurrence of the sheet having an unfixed image in the ink jet recording apparatus according to the first embodiment of the present invention.
Figure 6C:
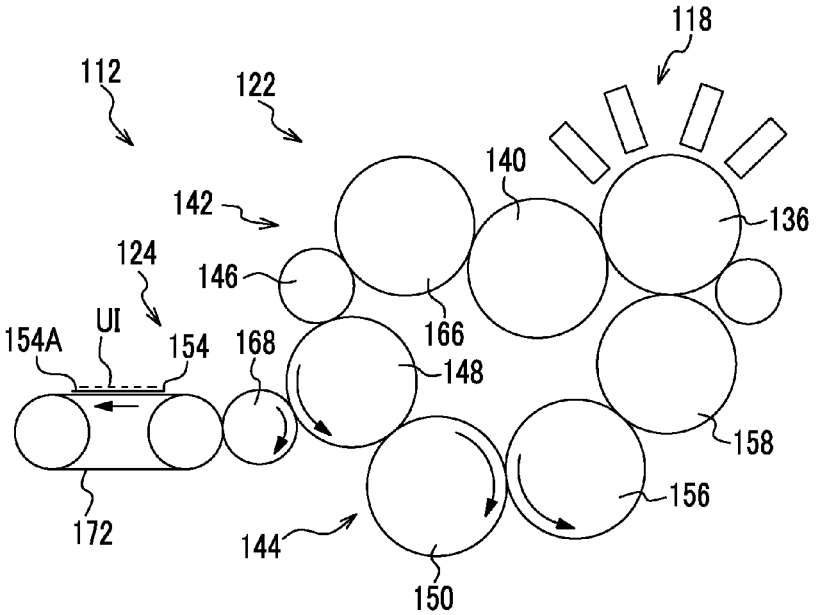
FIG. 6C is a schematic front view illustrating an operation in an occurrence of the sheet having an unfixed image in the ink jet recording apparatus according to the first embodiment of the present invention.

Specifically, the control unit 170 causes the pinch claw 168N of the discharge roller 168 to operate and pinch the leading edge of the sheet 154. Accordingly, as shown in FIGS. 6B to 6C, the sheet 154 on which an image is not yet fixed is sent to the discharge unit 124, and discharged to the sheet discharge tray 174 through the discharge roller 168 by the discharge belt 172. Since the sheet 154 on which an image is not yet fixed is not transported on the second transportation unit 144, the second transportation unit 144 is inhibited from being contaminated by an ink droplet of an unfixed image. Furthermore, since the sheet 154 is not sent to the image recording unit 118, it is possible to inhibit the ink jet recording head 138 from being contaminated.

When the sheet jam sensor 160 detects a jam of the sheet, there may be the sheet 154 which is sent out from the sheet feed tray 125 but does not yet reach the image recording unit 118, and to which an ink droplet is not attached at all. In this case, the control unit 170 controls the pinching claw 168 so as not to pinch the sheet 154 even when the leading edge of the sheet 154 reaches the discharge roller 168. The control unit 170 further controls the reverse roller 150 so as not to reverse the sheet 154. Accordingly, the sheet 154 on which an image is not formed is sent to the image recording unit 118 without being reversed. If the jam of the sheet is released, image recording is performed on the sheet 154. That is, it is possible to perform an image forming without wasting the sheet 154.

Moreover, since the sheet 154 is not reversed, the first surface 154A of the sheet 154 faces the ink jet recording head 138. That is, on the first surface 154A of the sheet 154, it is possible to record an image to be originally recorded on the first surface 154A. Thereafter, the sheet 154 is reversed and sent to the image recording unit 118 by the second transportation unit 144, and thereby, on the second surface 154B of the sheet 154, it is possible to record an image to be originally recorded on the second surface 154B.

Next, an operation will be described when the fixing ability of the ultraviolet emitter 128 is decreased for some reasons (when the fixing ability is decreased), and the fixing unit operation sensor 162 detects the decrease.

In this case, the control unit 170 causes the first transportation unit 142 and the second transportation unit 144 to continue transportation of the sheet 154. However, the sheet 154 on which a recording image is not yet fixed is sent to the discharge unit 124, and discharged to the sheet discharge tray 174, in a same way when the sheet jam occurs. That is, since the sheet 154 is not transported on the second transportation unit 144, the second transportation unit 144 is inhibited from being contaminated by an ink droplet of an unfixed image. Furthermore, the sheet 154 is not sent to the image recording unit 118, and thereby the ink jet recording head 138 can be inhibited from being contaminated.

When the fixing ability of the ultraviolet emitter 128 is decreased, the image recording unit 118 (the ink jet recording head 138) may stop ejecting an ink droplet to the sheet 154. Accordingly, the sheet 154 to which an ink is not fixed may be inhibited from occurring further.

In addition, since the first transportation unit 142 and the second transportation unit 144 continuously transport the sheet 154, when the fixing unit operation sensor 162 detects that the fixing ability of the ultraviolet emitter 128 is recovered, it is possible to continue image recording on the sheet 154. When the fixing unit operation sensor 162 detects that the fixing ability of the ultraviolet emitter 128 is not recovered, the control unit 170 stops an operation of the first transportation unit 142, the second transportation unit 144, the image recording unit 118, and the fixing unit 122, and if necessary, displays a decrease in the fixing ability of the ultraviolet emitter 128 (the fixing unit 122) on the display unit 170B.

Even when the fixing unit operation sensor 162 detects a decrease in the fixing ability of the ultraviolet emitter 128, similarly to a case of the jam of the sheet, there may be the sheet 154 which is sent out from the sheet feed tray 125 but does not yet reach the image recording unit 118, and to which an ink droplet is not attached at all. The control unit 170 causes the sheet 154 to be sent to the image recording unit 118 without being reversed. When the fixing ability of the ultraviolet emitter 128 is recovered, it is possible to perform image recording without wasting the sheet 154. However, since the sheet 154 is not reversed, an image may be first formed on the first surface 154A. The second transportation unit 144 reverses the sheet 154 and sends the sheet 154 to the image recording unit 118, and thereby an image can be formed on the second surface 154B.

Figure 6D:
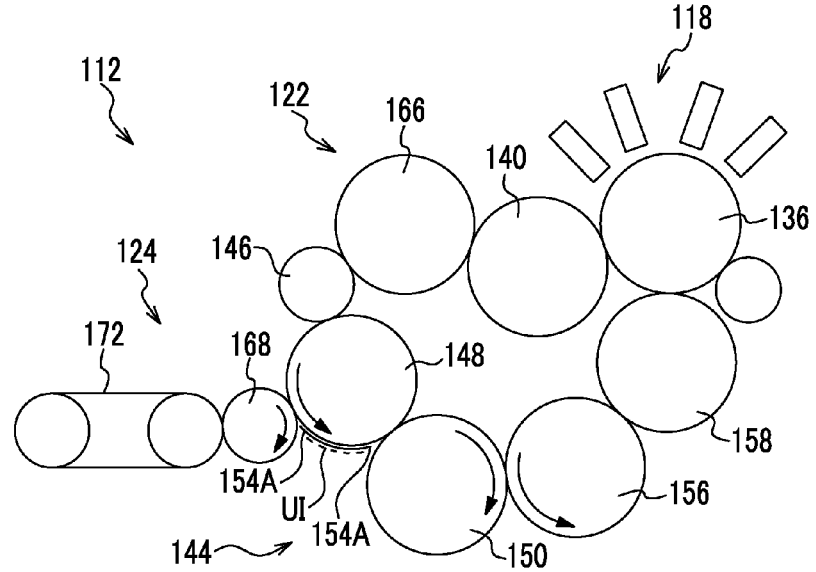
FIG. 6D is a schematic front view illustrating an operation in an occurrence of the sheet having an unfixed image in the ink jet recording apparatus according to the first embodiment of the present invention.
Figure 6E:
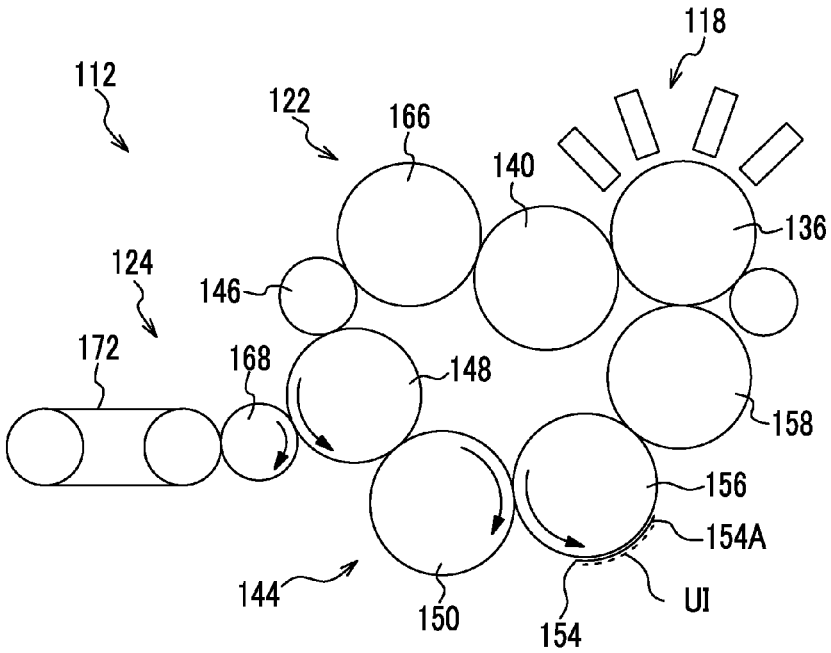
FIG. 6E is a schematic front view illustrating an operation in an occurrence of the sheet having an unfixed image in the ink jet recording apparatus according to the first embodiment of the present invention.

In addition, even if the sheet 154 includes an unfixed image UI, as shown in FIGS. 6D and 6E, the sheet 154 may be returned to the image recording unit 118 by the second transportation unit 144 without being reversed by the reverse roller 150. In a configuration for performing such operation, a recess portion may be formed in the reverse roller 150 or the transportation roller 158 similarly to the transportation roller 146, thereby having an image recording portion of the sheet 154 be in non-contact with the reverse roller 150 or the transportation roller 158.

In the present invention, a recording material used in image recording on a recording medium (the sheet 154) is not limited to the above described ink. For example, even when a toner or the like is used, there is a need to fix the toner attached to the sheet 154. When the toner is not fixed on the sheet 154, there is a disadvantage that a returning path may be contaminated by the unfixed toner. Accordingly, even in an image recording apparatus using a toner as the recording material, applying the present invention, it is possible to inhibit the returning path from being contaminated by the unfixed toner.

However, particularly in an ink jet recording apparatus, it is general to maintain a narrow clearance between the ink jet recording head and the recording medium (for example, approximately 2 mm to 3 mm). In the configuration, particularly when applying the present invention, it is possible to inhibit an ink jet recording head from being contaminated by an unfixed image.

In addition, any other types of the recording material applying member and the fixing member may be applied, which are configured according to the recording material.

The first transportation unit and the second transportation unit are not limited to a configuration including the above described roller (drum). For example, it may be configured to transport the recording medium by an endless belt.

What is claimed is:

1. An image forming apparatus comprising:

a recording material applying member configured to apply a recording material to a recording medium;

a fixing member configured to fix the recording material to the recording medium;

a first transportation unit configured to transport the recording medium to the recording material applying member and the fixing member;

a discharge unit configured to discharge the recording medium received from the first transportation unit;

a second transportation unit configured to return the recording medium received from the first transportation unit to the recording material applying member;

a reverse unit configured to reverse front and back surfaces of the recording medium, the reverse unit being provided in the second transportation unit;

a transportation path switching unit configured to transport the recording medium transported by the first transportation unit to the discharge unit or the second transportation unit; and a control device configured to control the transportation path switching unit so as to transport any one of the recording medium only, which is in an intermediate state of being applied the recording material by the recording material applying member, not reach the fixing member even if applying the recording material is finished, or which is in an intermediate state of being fixed by the fixing member in the recording medium staying at the upstream side of the fixing member, to the discharge unit when a fixing ability of the fixing member is decreased.

2. The image forming apparatus according to claim 1, wherein the reverse unit is configured to be switched between a reverse operation, which reverses the recording medium, and a non-reverse operation, which does not reverse the recording medium.

3. The image forming apparatus according to claim 2, further comprising:

a transportation failure detection unit configured to detect a transportation failure of the recording medium, wherein, when the transportation failure is detected by the transportation failure detection unit, the control device controls the transportation path switching unit so as to transport the recording medium staying at an upstream side of the fixing member to the discharge unit.

4. The image forming apparatus according to claim 3, further comprising the fixing ability detection unit configured to detect the fixing ability of the fixing member.

5. The image forming apparatus according to claim 4, wherein, when the fixing ability is decreased, the control device stops the recording material applying member.

6. The image forming apparatus according to claim 5, wherein, when the fixing ability is decreased, the control device controls the transportation path switching unit so as to transport the recording medium having one surface where an image is not formed and the other surface where there is no unfixed image to the second transportation unit.

7. The image forming apparatus according to claim 6, wherein, when the fixing ability is decreased, the control device controls the reverse unit so as not to reverse the recording medium.

8. The image forming apparatus according to claim 3, wherein, in a case of the transportation failure, the control device stops the first transportation unit and the second transportation unit.

9. The image forming apparatus according to claim 8, wherein, in the case of the transportation failure, the control device controls the transportation path switching unit so as to transport the recording medium having one surface where an image is not formed and the other surface where there is no unfixed image to the second transportation unit.

10. The image forming apparatus according to claim 9, wherein the control device controls the reverse unit so as not to reverse the recording medium in the case of the transportation failure.

11. The image forming apparatus according to claim 2, further comprising:

a fixing ability detection unit configured to detect a fixing ability of the fixing member.

12. The image forming apparatus according to claim 11, wherein, when the fixing ability is decreased, the control device stops the recording material applying member.

13. The image forming apparatus according to claim 12, wherein, when the fixing ability is decreased, the control device controls the transportation path switching unit so as to transport the recording medium having one surface where an image is not formed and the other surface where there is no unfixed image to the second transportation unit.

14. The image forming apparatus according to claim 13, wherein, when the fixing ability is decreased, the control device controls the reverse unit so as not to reverse the recording medium.

* * * * *